United States Patent [19]

Hargest et al.

[11] Patent Number: 4,967,431

[45] Date of Patent: Nov. 6, 1990

[54] FLUIDIZED BED WITH MODULAR FLUIDIZABLE PORTION

[75] Inventors: Thomas S. Hargest; Sohrab Soltaninasab; Robert C. Novack, all of Charleston, S.C.

[73] Assignee: SSI Medical Servies, Inc., Charleston, S.C.

[21] Appl. No.: 443,661

[22] Filed: Nov. 29, 1989

Related U.S. Application Data

[63] Continuation-in-part of Ser. No. 288,071, Dec. 20, 1988, Pat. No. 4,942,635.

[51] Int. Cl.[5] ..... A61G 7/057

[52] U.S. Cl. ..... 5/453; 5/449; 5/455

[58] Field of Search ..... 5/455, 453, 449, 469, 5/456, 457, 458, 450

[56] References Cited

U.S. PATENT DOCUMENTS

| | | | |
|---|---|---|---|
| 3,428,973 | 2/1969 | Hergest et al. . | |
| 3,459,179 | 8/1969 | Olesen | 5/481 |
| 3,762,404 | 10/1973 | Sakita | 5/449 |
| 3,866,606 | 2/1975 | Hargest . | |
| 4,163,297 | 8/1979 | Neumark | 5/455 |
| 4,234,982 | 11/1980 | Bez et al. | 5/455 |
| 4,425,676 | 1/1984 | Crane | 5/453 |
| 4,483,029 | 11/1984 | Paul | 5/453 |
| 4,564,965 | 1/1986 | Goodwin | 5/453 |
| 4,599,755 | 7/1986 | Tominaga | 5/453 |
| 4,637,083 | 1/1987 | Goodwin | 5/453 |
| 4,672,699 | 6/1987 | Goodwin | 5/430 |
| 4,694,521 | 9/1987 | Tominaga | 5/453 |

*Primary Examiner*—Alexander Grosz

*Attorney, Agent, or Firm*—Dority & Manning

[57] ABSTRACT

A patient support system has a fluidizable surface formed by air fluidizing a mass of fluidizable material. The fluidizable surface preferably is formed by a plurality of fluidizable cells disposed and attached atop an air permeable support with the aid of anchoring flaps, attachment flaps, and attachment mechanisms such as airtight zippers or mating elastomeric members. Each of these cells contains a discrete mass of fluidizable material and is manually, detachably removable from the support, without the aid of tools, for ease of cleaning and replacement. Each cell is laterally retained above the air permeable support by a member whcih is at least partially vertically collapsible so as to facilitate ingress and egress of the patient and the cells to and from the support system. The collapsible member can comprise an air impermeable panel which can form an inflatable elastic wall having one or more internal webs defining separately pressurizable compartments. A blower inflates the elastic wall and the fluidizable material via a network including manifolds, valves, and flexible tubing. A microprocessor controls actuation of the various valves and the blower according to signals inputted by operating personnel or supplied by various sensors which monitor the patient support system.

26 Claims, 10 Drawing Sheets

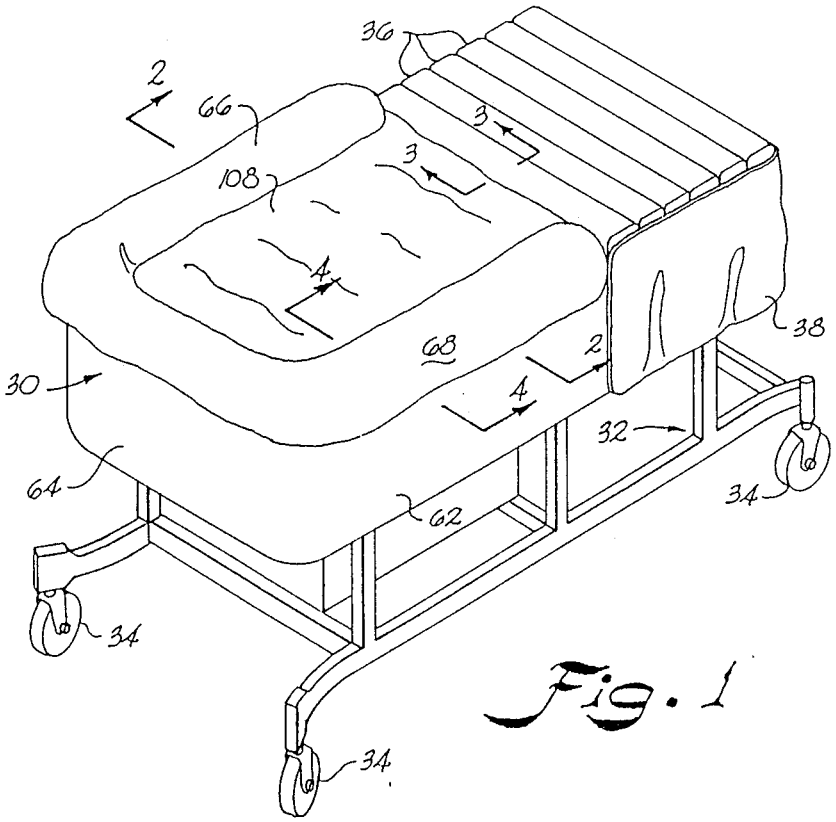
Fig. 1
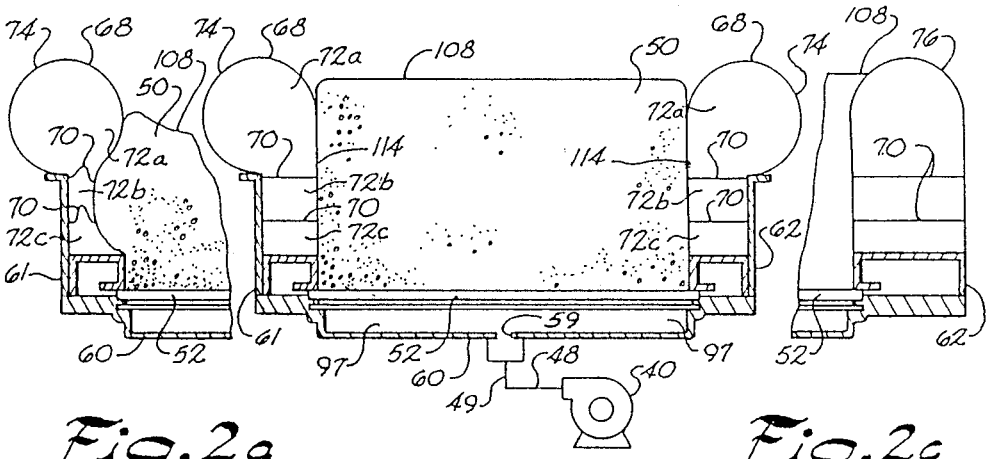
Fig. 2a
Fig. 2c
Fig. 2b

FLUIDIZED BED WITH MODULAR FLUIDIZABLE PORTION

BACKGROUND OF INVENTION

This application is a continuation-in-part application to U.S. application Ser. No. 07/288,071, filed Dec. 20, 1988, now U.S. Pat. No. 4,942,635 which is hereby incorporated herein by reference.

The present invention relates to patient support systems that support at least a portion of the patient with a mass of air fluidizable material.

One type of patient support system preferred for long-term patient care includes air fluidized beds such as those described in U.S. Pat. Nos. 3,428,973 to Hargest et al, 3,866,606 to Hargest, 4,483,029 to Paul, 4,564,965 to Goodwin, 4,637,083 to Goodwin, 4,672,699 to Goodwin.

The fluidizable material in a fluidized bed can be soiled and must be removed for cleaning at regular intervals and when particular circumstances dictate. Because of intermixing of the fluidizable material during fluidization, a localized soiling becomes distributed throughout the mass of material. Removal of the entire mass of material for cleaning can be a time consuming and labor intensive task.

PRINCIPAL OBJECTS AND SUMMARY OF THE INVENTION

It is a principal object of the present invention to provide an improved patient support system for long term patient care.

Another principal object of the present invention is to provide an improved patient support system providing fluidized patient support while facilitating handling of the fluidizable material.

A still further principal object of the present invention is to provide an improved patient support system providing fluidized patient support that facilitates removal and replacement of the fluidizable material.

Still another principal object of the present invention is to provide an improved patient support system providing fluidized patient support while rendering maintenance of the fluidizable material more economic.

Additional objects and advantages of the invention will be set forth in part in the description which follows, and in part will be obvious from the description to those of ordinary skill in this art, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the patient support system providing fluidized support to at least a portion of the patient's body comprises a frame which carries a fluidizable medium that supports at least a portion of the patient's body, and especially the buttocks of the patient. As is conventional, the fluidizable medium preferably includes fluidizable material such as tiny spheres formed of glass, ceramics, and/or silicon.

The invention further preferably includes means for permitting the diffusion of air through the fluidizable medium. The means for permitting air to fluidize the fluidizable mass of material preferably includes an air permeable support such as a diffuser board that is permeable to air but impermeable to the fluidizable medium.

The invention also preferably includes means for laterally retaining the mass of fluidizable material above the air diffusion means. A preferred example of the lateral retaining means includes an elastic, collapsible retaining means which extends in a direction generally normal to the diffuser board. The fluidizable material is supported on or above the diffuser board and is laterally retained thereabove by the retaining means which can be secured to the diffuser board in airtight fashion.

In yet further accordance with the present invention, means are provided for enclosing and containing the mass of fluidizable material and permitting selective manual removal of the containing means from the support system without prior removal of the mass of fluidizable material from the enclosing and containing means. As embodied herein, the enclosing and containing means preferably includes at least one fluidizable cell. Each cell has an upper wall, a lower wall, and a side wall extending between the upper wall and the lower wall. Each cell contains a mass of fluidizable material therewithin, and the walls are substantially impermeable to the fluidizable material and thus prevent the passage of this fluidizable material therethrough. The upper wall and the lower wall are permeable to the passage of air therethrough, but the side wall preferably is not. Preferably, the containing means contains the mass of fluidizable material in at least two selectively separable masses of fluidizable material, and at least two discrete fluidizable cells can be disposed adjacent each other for this preferred embodiment.

In still further accordance with the present invention, means are provided for manually, selectively, and detachably connecting the containing means to the support system. As embodied herein, this connecting means preferably includes an attachment mechanism such as at least one air tight zipper. In an alternative embodiment, the attachment mechanism of the connecting means preferably includes at least one pair of mating elastomeric interlocking members. In a still further embodiment, a combination of air tight zippers and mating elastomeric interlocking members can be used. The connecting means can also include attachment flaps connected to the cells and anchoring flaps connected to the support system. The attachment mechanism preferably is mounted so as to join the attachment flap to a corresponding anchoring flap in an attachable/detachable relationship. The connecting means permits the containing means to be selectively engagable to and disengagable from the support system, without the aid of tools, to permit the manual removal of the containing means from the support system and replacement of the removed containing means with a replacement containing means.

More specifically, the connecting means of the present invention connects at least a portion of each fluidizable cell so as to ensure adequate flow of air through the lower walls to fluidize the mass of fluidizable material contained in the cells. In a preferred embodiment, the connecting means connects each fluidizable cell to the diffuser board. For example, the lower walls of each cell are maintained above or against the diffuser board and detachably anchored thereto so that air passing through the diffuser board must pass through the lower walls of the cells and thereby fluidize the fluidizable material therewithin. In some embodiments, portions of the lower walls of adjacent fluidizable cells are connected to each other, while portions of the lower walls near the retaining means are connected thereto or to the diffuser board at its peripheral portion located in the vicinity of the retaining means.

As to the portion of the periphery of the upper wall of each cell that is adjacent the retaining means, means are provided for detachably attaching the cell in the vicinity of the upper wall to the retaining means so as to prevent passage of the fluidizing supply of air past this detachably attaching means. The detachably attaching means preferably includes an attachment mechanism such as an airtight zipper or a pair of mating elastomeric interlocking members. One of the engagable components of the zipper or interlocking members can be secured to the end of an attachment flap that is secured to the retaining means. The attachment flap preferably is both air impermeable and impermeable to the passage of fluidizable material therethrough.

The connecting means of the fluidizable cells and the detachably attaching means of the cells greatly facilitate removal of the fluidizable medium for cleaning. Each cell confines soiling within itself and so prevents localized soiling from being distributed throughout the fluidizable medium. The sidewall's impermeability to air is a feature which assists in preventing localized soiling from spreading throughout the entire mass of fluidizable material.

In embodiments with a plurality of cells, the connecting means of the present invention also can include means for disposing at least a portion of the upper wall of each fluidizable cell adjacent at least a portion of the upper wall of each adjacent fluidizable cell so as to function as a continuous upper surface, similar to the air permeable sheet of a conventional air fluidized bed. As embodied herein, the disposing means preferably includes VELCRO brand strips of hook and loop fasteners extending along the sidewalls of the cells to connect upper portions of adjacent cells. In an alternative embodiment with a plurality of cells, the peripheries of the upper walls of each cell also can be connected to one another in the same detachable fashion as they are connected to the retaining means. In this way, the upper wall of each cell preferably forms a detachably engagable section of an air permeable cover sheet.

The retaining means preferably includes an elastic wall which preferably is vertically collapsible and takes the form of a number of different embodiments. In one embodiment, the elastic wall includes an inflatable U-shaped member with an inflatable interface sack at the open end of the U-shaped member. The U-shaped member and the interface sack can have one or more internal webs defining separately pressurizable compartments therewithin. In addition, deformable inserts can be disposed to fill the compartments. In another embodiment of the elastic wall, the open end of the U-shaped member is sealed by a non-rigid panel which is impermeable to the passage of both air and fluidizable material therethrough. In yet another embodiment, the elastic wall is defined by a non-rigid panel completely surrounding the fluidizable material. A portion of the panel is supported by the inflatable sacks, while the remainder of the panel is supported by a rigid sidewall which is selectively collapsible either by a grooved track mechanism or a bottom-hinged mechanism. The collapsibility of the retaining means embodiments greatly facilitates patient ingress to and egress from the dual mode patient support system of the present invention.

It is important that the air passing through the diffuser board is constrained to pass through the fluidizable medium to fluidize same. Accordingly, in some elastic wall embodiments, the elastic wall preferably has an attachment flap with an anchoring member at the free end thereof for anchoring the flap against the edge of the diffuser board which then is further sealed by a silicone rubber sleeve around the free edge thereof and by a bead of room temperature vulcanizing compound (RTV).

Preferably, the diffuser board defines the upper member of an air plenum chamber to which air is supplied. The air supplied to the plenum cannot escape therefrom except by diffusion through the diffuser board to fluidize the fluidizable material supported thereabove. The means for supplying air to the plenum for fluidizing the fluidizable medium preferably includes a blower, a blower manifold, a fluidization supply manifold, one or more flow control valves, and a plurality of flexible air conduits. The diffuser board preferably has at least two tiers disposed at two different levels above the bottom of the plenum, which is subdivided into at least two chambers that are separately pressurizable from one another. One tier is disposed to support the fluidizable material that supports the patient's buttocks, and this tier is closer to the bottom of the plenum and therefore supports a relatively larger depth of fluidizable material than the second tier which supports the fluidizable material beneath the legs and feet of the patient. The reduced depth of material for supporting the legs and feet of the patient reduces the weight of the system. It also enables use of a smaller blower, and this lowers the power requirements of the system as well as further reducing the weight of the system.

Preferably, pressure is maintained in the inflatable components of the support system by connecting the blower to a manifold which supplies air to the pressure control valves via a plurality of flexible air conduits.

A microprocessor preferably controls the pressure provided to the inflatable components, and the rate of flow of air provided to the plenum which fluidizes the fluidizable material. The valves have a pressure sensing device that measures the pressure at the outlet of each valve. Each valve's outlet is opened or closed to varying degrees by a motor. The microprocessor receives pressure information from each valve via the pressure sensing device and controls the motor to open or close the valve accordingly. Each component or group of components which is desired to be maintained at a controllable pressure or flow rate is connected to the blower via an individual pressure control valve or flow control valve, respectively. The microprocessor then is programmed to control this valve according to the desired pressure or flow rate behavior for that particular component. Accordingly, each valve defines its own particular zone which is subject to individual control by the microprocessor. The operating parameters can be inputted as desired by a key pad and control panel connected to the microprocessor. The microprocessor stores various control programs that can be activated via the key pad and control panel.

One of the operational programs for the microprocessor is the continuous mode of fluidization of the fluidizable material. Air is continuously supplied to the plenum at a minimum mode of fluidization, a maximum mode of fluidization, and an intermediate mode of fluidization. In addition, the microprocessor can supply air to the plenum so as to intermittently fluidize the fluidizable material. This is accomplished by turning off the fluidization for a short interval of time followed by fluidizing for a brief interval of time and repeating this sequence over and over.

Each control valve can be operated in a mode which instantaneously opens the valve. This mode of operation is useful for depressurizing an inflatable sack to facilitate an emergency medical procedure requiring a rigid surface rather than the compressible surface afforded by the inflatable sacks. The instantaneous depressurization can be controlled by the key pad of the control panel of the microprocessor.

A heat exchange device can be provided to regulate the temperature of the air being used to fluidize the mass of fluidizable material.

The microprocessor controls the overall pressure and flow rates of air being supplied to the patient support system by controlling the blower via a blower control board that receives signals from a pressure sensor which monitors the pressure at the outlet side of the blower.

An articulatable member can be attached to the frame and used to support inflatable sacks thereon. In such articulatable embodiments, means can be provided for defluidizing the mass of fluidizable material during elevation of the articulatable member. Conventional hydraulics and motors are used to effect articulation of the articulatable member, and these hydraulics and motors are under the control of the microprocessor. In addition, a sensing device monitors the degree of articulation of the articulatable member and furnishes this information to the microprocessor. The operator selects the degree of elevation of the articulation member via the key pad and control panel, and the microprocessor then activates the hydraulics and motors until the articulation sensing device signals that the desired level of articulation has been attained. In conjunction with the elevation of the articulatable member, the microprocessor closes the flow control valve that governs the fluidization of the plenum chamber responsible for supplying air to fluidize the mass of fluidizable material beneath the buttocks of the patient. This defluidizes the mass of fluidizable material supporting the buttocks of the patient. The defluidized material beneath the buttocks of the patient acts to prevent the buttocks from moving in a direction toward the feet of the patient as weight is transferred against the buttocks during elevation of the head and chest of the patient. Thus, the defluidization of the mass of fluidizable material supporting the buttocks acts as a substitute for a knee patch that often is required when elevating the head and chest of a patient in a conventional bed. The prevention of movement of the buttocks provides the additional benefit of restraining the patient from any slipping and sliding that might cause tissue damage to any sacral skin grafts which may exist on the patient.

Moreover, after the articulatable member has attained the desired angle of elevation, the microprocessor causes the brief fluidization of the fluidizable material supporting the buttocks of the patient. The duration of this brief fluidization is no longer than required to contour the mass of fluidizable material supporting the buttocks in the sitting position. The fluidization is brief enough so that the patient does not feel the sensation of sinking into the mass of fluidizable material in the buttock zone during defluidization.

The accompanying drawings which are incorporated in and constitute a part of this specification, illustrate one embodiment of the invention and, together with the description, serve to explain the principles of the invention.

BRIEF DESCRIPTION OF THE DRAWINGS

FIG. 1 illustrates a perspective view of an embodiment of the present invention;

FIG. 2*a* illustrates a partial cross-sectional view of components of an embodiment of the present invention in a defluidized state taken along the lines 2—2 of FIG. 1;

FIG. 2*b* illustrates a cross-sectional view of components of an embodiment of the present invention in a fluidized state taken along the lines 2—2 of FIG. 1;

FIG. 2*c* illustrates a partial cross-sectional view of components of an embodiment of the present invention in a fluidized state taken in a direction similar to the lines 2—2 of FIG. 1;

DETAILED DESCRIPTION OF THE PREFERRED EMBODIMENTS

Figure 3A:
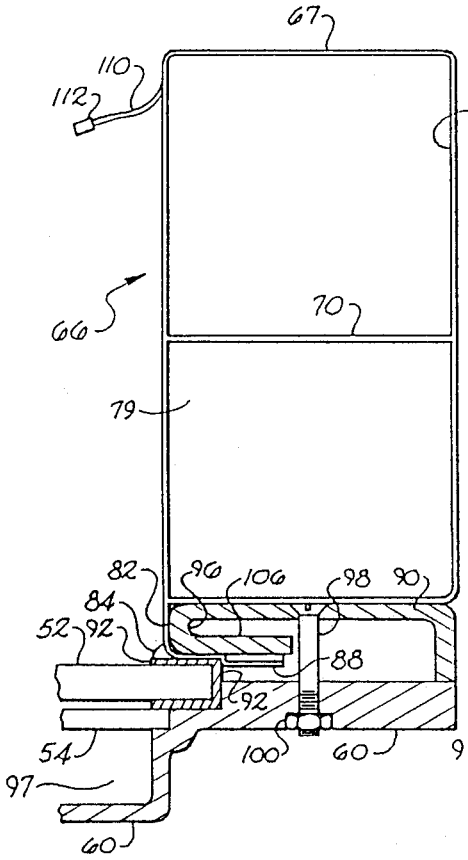
FIG. 3*a* illustrates a detailed cross-sectional view of components of an embodiment of the present invention taken in a direction similar to the lines 3—3 of FIG. 1.

Reference now will be made in detail to the presently contemplated preferred embodiments of the present invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover the modifications and variations of this invention provided they come within the scope of the appended claims and their equivalents.

In accordance with the present invention, a mass of a fluidizable medium is carried by a frame to support at least a portion of the patient's body. As embodied herein and shown in FIGS. 8 and 9, for example, a plurality of tiny particles 50 forms a fluidizable medium. Preferably, each particle 50 is formed as a sphere having a diameter on the order of one thousandth of an inch and more particularly in the range of 50 to 150 microns. Suitable materials for forming particles 50 include ceramics, glass, and silicon. Preferably, a silicon coating is applied to a ceramic bead or to a glass bead.

Typically, a patient support system having an air fluidizable portion includes some type of a frame which carries the fluidizable portion and usually other components of the system. An example of a dual mode patient support system is shown in FIG. 1 and is represented generally by the numeral 30. While the present invention is explained using a dual mode patient support system as an example, the present invention can be used advantageously in any patient support system that relies at least in part on an air fluidized mass of material. System 30 includes a frame which is indicated generally in FIG. 1 by the designating numeral 32. Frame 32 can be provided with a plurality of rolling casters 34 for facilitating movement of patient support system 30. The diameter of the rotating member of each caster 34 preferably is a minimum of seven inches, and each caster 34 is preferably spring-loaded. Frame 32 preferably is constructed of rigid material such as tubular or angled metal capable of supporting the weight of the components carried thereon. The fluidizable material alone weighs on the order of one thousand pounds, and frame 32 shown in FIG. 1 must be capable of carrying the fluidizable material shown in FIGS. 8 and 9 for example.

In accordance with the present invention, means is provided for enclosing and containing the mass of fluidizable material and permitting selective manual removal of the containing means from the support system and without prior removal of the mass of fluidizable material from the enclosing and containing means. The means for enclosing and containing the mass of fluidizable material is preferably capable of being selectively detached and attached with respect to the rest of the support system and without prior removal of the mass of fluidizable material from the containing means. As embodied herein and shown in FIGS. 7–9 for example, the enclosing and containing means preferably comprises at least one fluidizable cell 134. In a further preferred embodiment, the enclosing and containing means contains the mass of fluidizable material in at least two selectively separable masses of fluidizable material, and thus includes at least two fluidizable cells 134.

Figure 7:
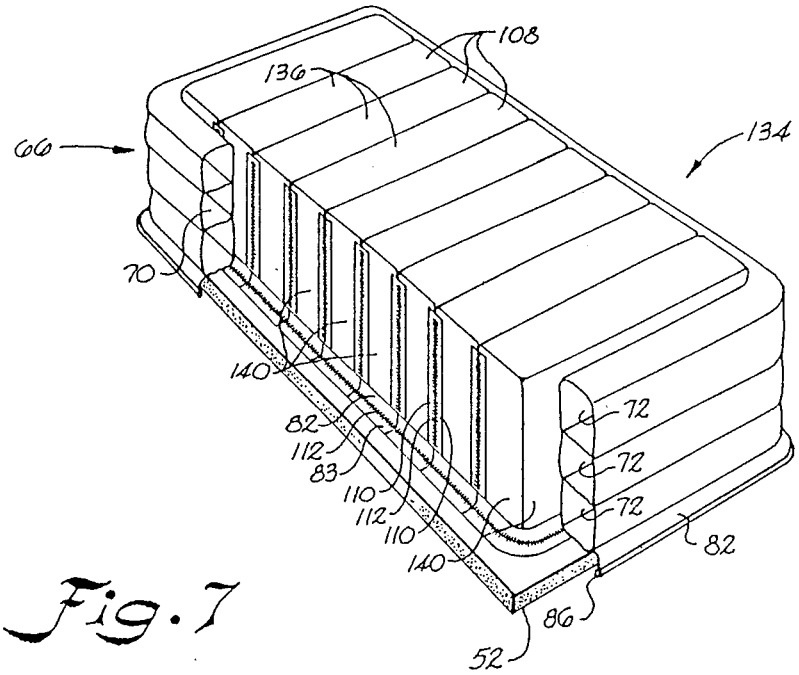
FIG. 7 illustrates a perspective, partially cut-away view of components of an embodiment of the present invention.
Figure 8:
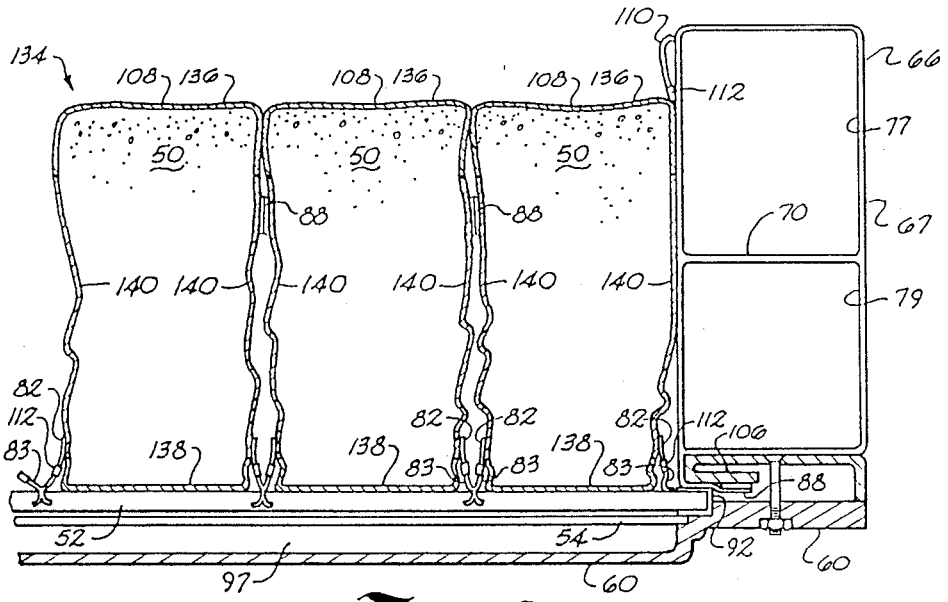
FIG. 8 illustrates a cross-sectional view of components of an embodiment of the present invention in a defluidized state.
Figure 9:
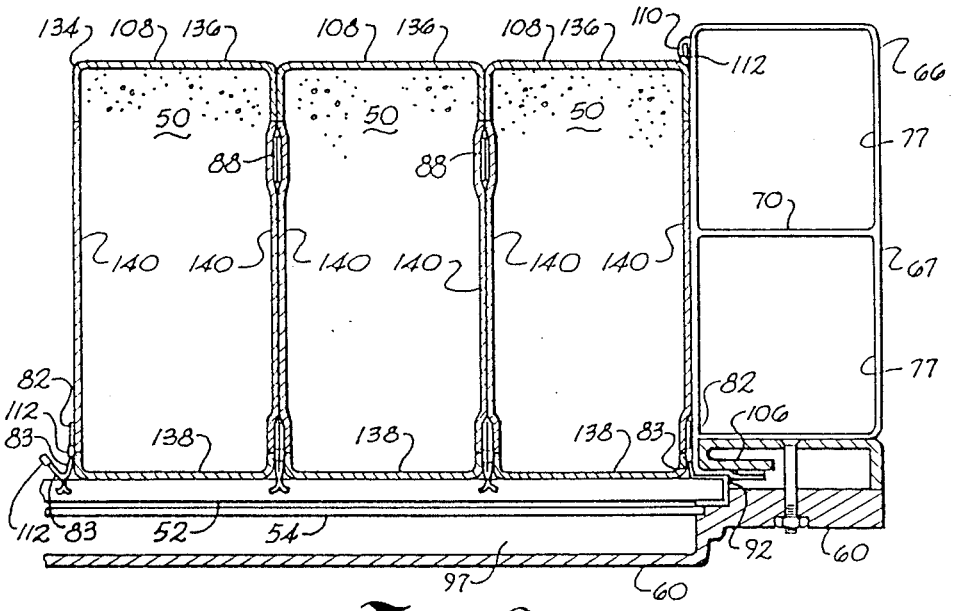
FIG. 9 illustrates a cross-sectional view of components of an embodiment of the present invention in a fluidized state.

A plurality of fluidizable cells 134, such as shown in FIGS. 7, 8, and 9 for example, provides means for containing a fluidizable medium in a selectively separable modular array of discrete cells. Each fluidizable cell 134 has an upper wall 136, a lower wall 138, and a sidewall 140 extending between and connecting the upper wall and the lower wall. Each cell 134 contains a mass of fluidizable material 50 therein, and walls 136, 138, and 140 are impermeable to passage of the fluidizable material therethrough. Each upper wall 136 and each lower wall 138 of each fluidizable cell 134 is permeable to the passage of air therethrough. Suitable material for fabricating upper wall 136 and lower wall 138 includes a fine mesh nylon fabric that prevents passage of particles having a narrowest dimension measuring 30 microns. Each sidewall 140 of each fluidizable cell 134 is preferably impermeable to passage of fluidizable material therethrough and to passage of air therethrough. A suitable material for fabricating such sidewall 140 includes a nylon base fabric coated with polyurethane. The seams connecting upper wall 136 to sidewall 140 and lower wall 138 to sidewall 140 preferably are heat sealed or adhesively sealed so as to be substantially impermeable to air and to material 50. In such preferred embodiment in which air is prevented from passing through sidewall 140, airborne waste material is not likely to be transmitted between each individual cell. Thus, it becomes possible to confine such waste material within the individual cell in which it first resides.

Figure 10:
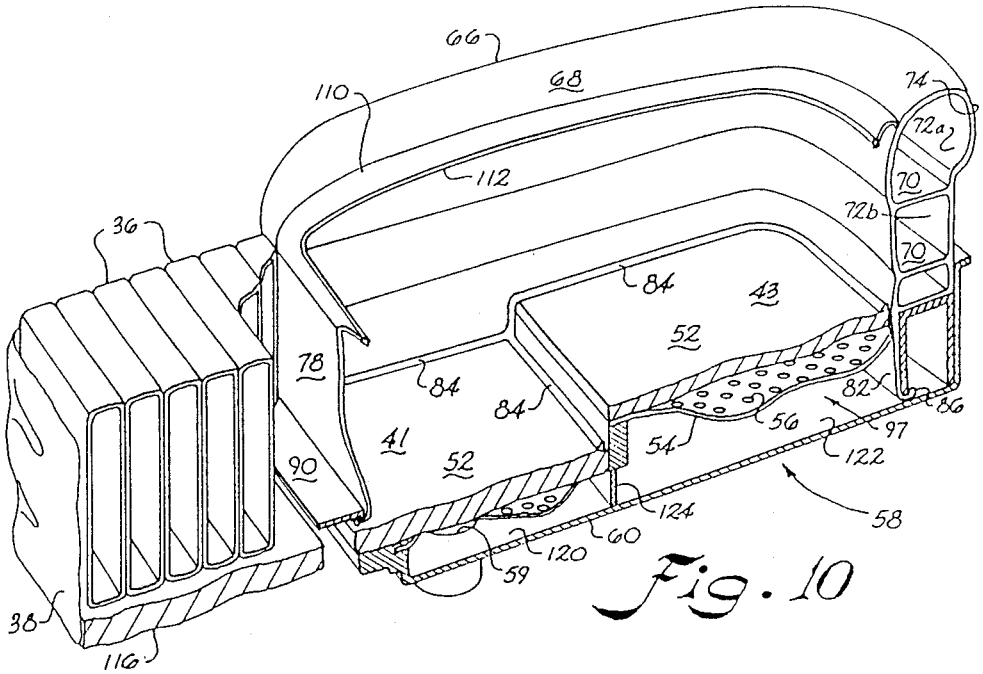
FIG. 10 illustrates a perspective, cut-away view of components of an embodiment of the present invention.

In further accordance with the present invention, in order to facilitate carriage of the mass of fluidizable material by the frame, means is provided for supporting the fluidizable medium and for permitting the diffusion of air through the fluidizable medium. Preferably, the air permeable supporting means is carried by the frame. As embodied herein and shown in FIGS. 7, 8, 9, 10, 12*a*, 12*b*, and 12*c*, the air permeable means for supporting the fluidizable medium preferably includes an air permeable support such as a diffuser board 52, which preferably is formed of particle board or other air-permeable material which also happens to be impermeable to the passage of particles 50 therethrough. Diffuser board 52 is carried by frame 32. In preferred embodiments shown in FIGS. 6 and 8–10 for example, a perforated metal plate 54 is provided beneath diffuser board 52 to support and reinforce same. As shown in FIG. 10 for example, perforated plate 54 includes a plurality of holes 56 extending through plate 54 to allow for passage of air therethrough. Perforated plate 54 is also carried by frame 32 and preferably is fabricated of a sturdy but light weight metal such as aluminum or light gauge steel.

The invention also preferably includes means for laterally retaining the mass of fluidizable material above the air diffusion means. The retaining means prevents the lateral spreading of the fluidizable material and keeps the fluidizable material oriented above the air diffusion means. A preferred example of the lateral retaining means includes an elastic, collapsible retaining means which extends in a direction generally normal to the diffuser board. One preferred embodiment of the retaining means is an elastic wall 66, which is described in greater detail below. The lateral retaining also can include a rigid wall member such as walls 61, 62 and 64 of tank 58 described below and shown in FIGS. 1 and 2 for example, or rigid tank sidewall 81 described below and shown in FIGS. 12*a*, 12*b* and 12*c*.

In further accordance with the present invention, means are provided for manually, selectively, and detachably connecting the containing means to the support system. Moreover, the containing means must be connected to the rest of the support system in a manner that constrains the air supply along a path whereby the air fluidizes the fluidizable material held within the containing means. Accordingly, in one preferred embodiment shown herein, the connecting means preferably includes means for connecting the containing means to the air permeable supporting means. As embodied herein and shown in FIGS. 7, 8, and 9 for example, the means for connecting the containing means to the air permeable means for supporting the fluidizable medium preferably includes an attachment flap 82, an anchoring flap 83, and a means for securing the attachment flap to the anchoring flap without permitting passage of air thereby. Preferably, flaps 82, 83 are flexible and formed of vinyl, plastic, urethane coated nylon, or any other material that is both flexible, durable and impermeable to air. An attachment flap 82 preferably circumscribes completely around the periphery of lower wall 138, as by heat sealing or adhesive, and extends from the lower portion of sidewall 140 near lower wall 138 of each fluidizable cell. One end of an anchoring flap 83 is secured to diffuser board 52 in any conventional manner that prevents air from flowing past the interface between flap 83 and board 52. A bolted clamp is one suitable manner of securement of flap 83 to board 52. As shown in FIGS. 8 and 9 for example, one end of each flap 83 is embedded in board 52. Anchoring flap 83 is disposed continuously along board 52 so as to be easily connected to a corresponding free end of attachment flap 82 via an attachment mechanism. Each lower wall 138 of each fluidizable cell 134 is thereby connected to diffuser board 52 via anchoring flap 83, attachment flap 82, and means for securing the anchoring flap to the attachment flap in an air impermeable fashion.

Figure 5:
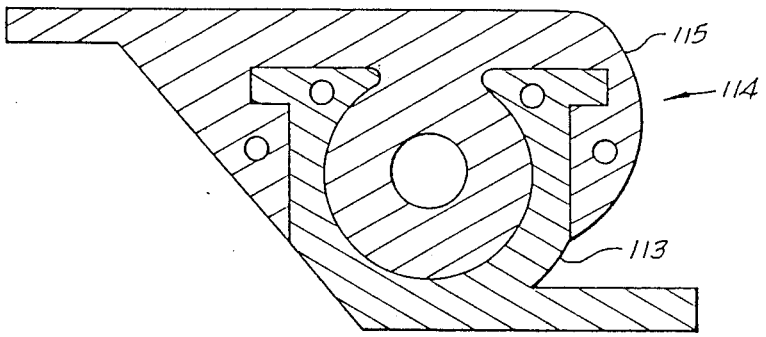
FIG. 5 illustrates a cross-sectional view of components of an embodiment of the present invention.

As embodied herein and shown in FIGS. 8 and 9 for example, the means for securing the attachment flap to the anchoring flap preferably comprises an attachment mechanism such as an air impermeable zipper 112. An alternative preferred embodiment of the securing means includes a pair of mating elastomeric interlocking members 113, 115 such as shown in FIG. 5 for example. Interlocking members 113, 115 mate together to form an airtight seal. Preferably, the two elastomeric members are easily deformable to come apart and join together under the manipulation of human hands unaided by tools and without exceptional manual strength or dexterity. In both preferred embodiments, the connecting means is selectively engagable and disengagable by hand, and without the aid of tools, to permit manual removal of each fluidizable cell and substitution of a replacement fluidizable cell for the removed cell.

Each of attachment flap 82 and anchoring flap 83 is impermeable to the passage of air thereby. Moreover, in multi-cell embodiments, the next adjacent cell 134 is similarly connected to diffuser board 52 in a fashion so that there is little or no portion of diffuser board 52 that is not covered by either a lower wall 138 of a sack 134 or the air impermeable combination of anchoring flap 83, attachment flap 82, and an attachment mechanism such as air tight zipper 112. In this way, air passing through diffuser board 52 must pass through lower walls 138 and thereby fluidize the fluidizable material 50 contained in each cell 134.

Figure 6:
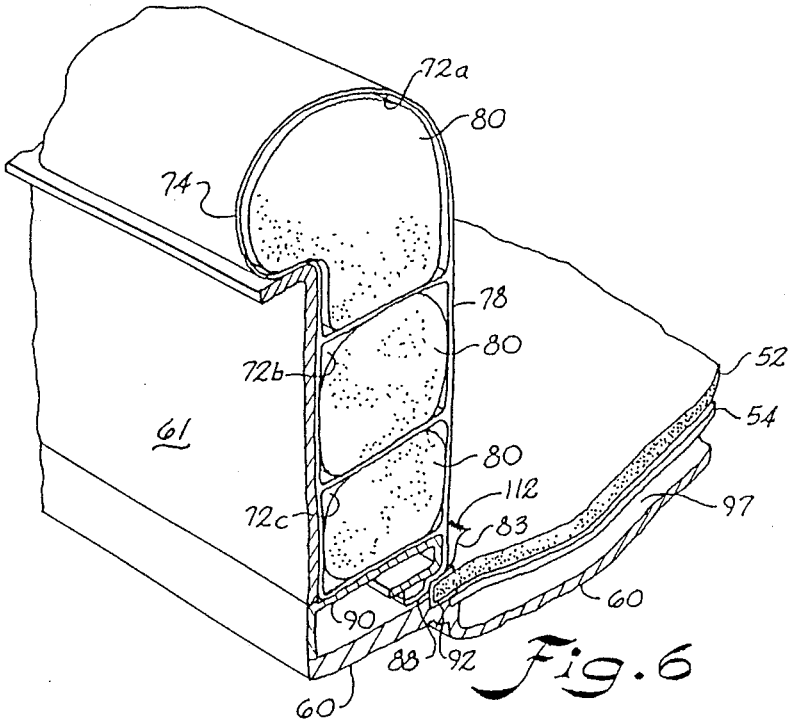
FIG. 6 illustrates a perspective, cut-away view of components of an embodiment of the present invention.

In an alternative embodiment, the periphery of each cell closest to the retaining means, such as elastic wall 66, can be attached to the retaining means. As shown in FIG. 6 for example, anchoring flap 83 extends from the base of elastic wall 66 instead of from diffuser board 52. This alternative embodiment of attaching cells to the support system especially pertains to the portion of the lower periphery of the cells disposed adjacent the retaining means. Where there are a plurality of fluidizable cells, the portion of the attachment flap of the fluidizable cell closest to the peripheral edge of diffuser board 52 attaches via an embodiment of the securing means to the anchoring flap which extends from the edge of diffuser board 52. The remaining portion of the attachment flap will be adjacent a portion of the attachment flap of an adjacent cell. An embodiment of the connecting means can be used for connecting at least a portion of adjacent cells near the lower wall of each fluidizable cell to at least a portion of its neighboring cell in the vicinity of the lower wall of the cell. For example, the remaining periphery of each lower wall of each cell 134 can be connected to the adjacent portion of the lower wall of adjacent cells 134 by attachment flaps 82 and attachment mechanisms such as zipper 112. Once again, substantially the entire surface of diffuser board 52 is covered by lower walls 138 of cells 134. In this way, the flow of air through the diffuser board is constrained to pass through lower walls 138 of cells 134 and cannot leak between cells 134 and elastic wall 66 for example. This ensures that there will be an adequate flow of air through the lower walls of the fluidizable cells to fluidize the mass of fluidizable material contained in the cells.

As to the section of the periphery near the upper wall of each cell that is adjacent the retaining means, means are provided for detachably attaching the cell in the vicinity of the upper wall to the retaining means so as to prevent passage of the fluidizing supply of air past this detachably attaching means. The detachably attaching means aids in ensuring that any air which happens to leak past the connecting means near lower walls 138 cannot escape and thereby short circuit the air flow path which leads through lower walls 138 of sacks 134 and results in fluidization of mass of material 50 held within cells 134. As embodied herein and shown in FIG. 8 for example, the detachably attaching means preferably includes a flexible attachment flap 110 connected to the retaining means. At the end of attachment flap 110 is an attachment mechanism such as an air tight zipper 112 or an elastomeric interlocking mechanism 114 (shown in FIG. 5 for example). The attachment mechanism can have one of its detachable members secured to a portion of the periphery of cell 134 near upper wall 136 either directly or via an attachment flap in similar fashion to construction of the connecting means already described. Attachment flap 110 preferably is impermeable to the passage of air therethrough and to the passage of fluidizable material therethrough. Moreover, attachment flap 110 preferably is secured to the retaining means so that air cannot escape past the interface between flap 110 and the retaining means. In embodiments where the retaining means is an elastic wall, attachment flap 110 can be constructed and secured in a fashion similar to attachment flap 82 of the connecting means. The detachably attaching means is selectively engagable and disengagable by hand and without the aid of tools or any great manual strength or dexterity.

The ease with which the embodiments of the connecting means and the detachably attaching means can be engaged and disengaged by hand greatly facilitates the removal of the fluidizable material whenever replacement is desirable. It also greatly facilitates replacement of cells 134 whenever replacement is needed. For example, replacement would be indicated if soiling of upper wall 136 requires that it be changed. Since the fluidizable material cannot pass through any of the cell walls, personnel can remove cells 134 and thereby remove the fluidizable material without coming into direct contact with same. Moreover, the size of each cell 134 can be such as to hold only enough fluidizable material so that the cell would be lightweight and could be lifted manually from the patient support system. The collapsible lateral retaining means further facilitates the lifting of cells 134 to remove and replace same.

In embodiments having a plurality of cells, the connecting means of the present invention also can include means for disposing at least a portion of the upper wall of each fluidizable cell adjacent at least a portion of the upper wall of each adjacent fluidizable cell so as to function as a substantially continuous upper surface, similar to the air permeable sheet of a conventional air fluidized bed. As embodied herein, the disposing means preferably includes strips of hook and loop fasteners extending along the sidewalls of the cells near the upper walls thereof and facing one another. As shown in FIGS. 8 and 9 for example, hook and loop strips 88, such as VELCRO strips, are provided to connect adjacent sidewalls 140 of adjacent cells 134. These strips 88 preferably are located near the interface between upper wall 136 and sidewall 140 of each cell 134. In this way, all of the upper walls 136 of cells 134 are connected to and/or disposed alongside one another. An alternative embodiment of the disposing means preferably includes an embodiment of the connecting means used to connect the peripheries of the cells near the upper walls of same in the same detachable fashion as is used to connect the cells to diffuser board 52 for example. The periphery of each cell 134 can have an attachment flap with one member of an attachment mechanism mounted to the free end thereof for joining with its opposite member disposed on the end of a corresponding attachment flap near the upper wall of the adjacent cell 134. When the attachment mechanisms are closed in an air impermeable fashion, all of the upper walls of the cells are joined together to form a surface that resembles an air permeable cover sheet of a conventional fluidized bed. In this way, each upper wall of each cell preferably forms a detachably engagable section of an air permeable cover sheet.

In summary, cells 134, the retaining means (described in greater detail hereafter), and the diffuser board can be connected to one another and thereby cooperate to provide means for containing the fluidizable medium and for permitting the diffusion of air therethrough. Since all of the cells are connected or disposed next to one another, upper walls 136 of cells 134 are in effect combined to form an air permeable surface which functions like an air permeable sheet 108 (FIG. 1) to prevent passage of the fluidizable material therethrough while at the same time permitting passage of air therethrough in order to allow air to pass through fluidizable material 50 and fluidize same.

Means are provided for defining at least one air plenum beneath the supporting and diffusing means. The air plenum defining means is carried by the frame and has a predetermined section through which air is permeable. As embodied herein and shown in FIG. 10 for example, the air plenum defining means preferably includes diffuser board 52 and a tank indicated generally in FIG. 10 for example by the designating numeral 58. Diffuser board 52 preferably is disposed over a bottom 60 of tank 58 to form the upper member defining an air plenum 97 therebetween and comprises the predetermined section of the plenum defining means through which air is permeable.

Tank 58 has a bottom 60, a pair of opposite sidewalls 61, 62, and a closed end wall 64. Tank sidewalls 61, 62 and tank end wall 64 extend substantially in a direction normal to tank bottom 60. Sidewalls 61, 62 and end wall 64 preferably are integral and form a continuous wall disposed generally vertically relative to a horizontally disposed tank bottom 60. Tank 58 has an open top and can be open at one end thereof as in FIGS. 1 and 10 for example. Tank 58 can be formed of metal and preferably is formed of fiberglass or heat resistant plastic to reduce the overall weight of the patient support system. As shown in FIG. 10 for example, tank 58 has at least one opening 59 through tank bottom 60 through which a gas, preferably air, can be supplied to tank 58 and each air plenum. In a multi-plenum embodiment such as shown in FIG. 10, tank bottom 60 is provided with an opening for each plenum.

Figure 13:
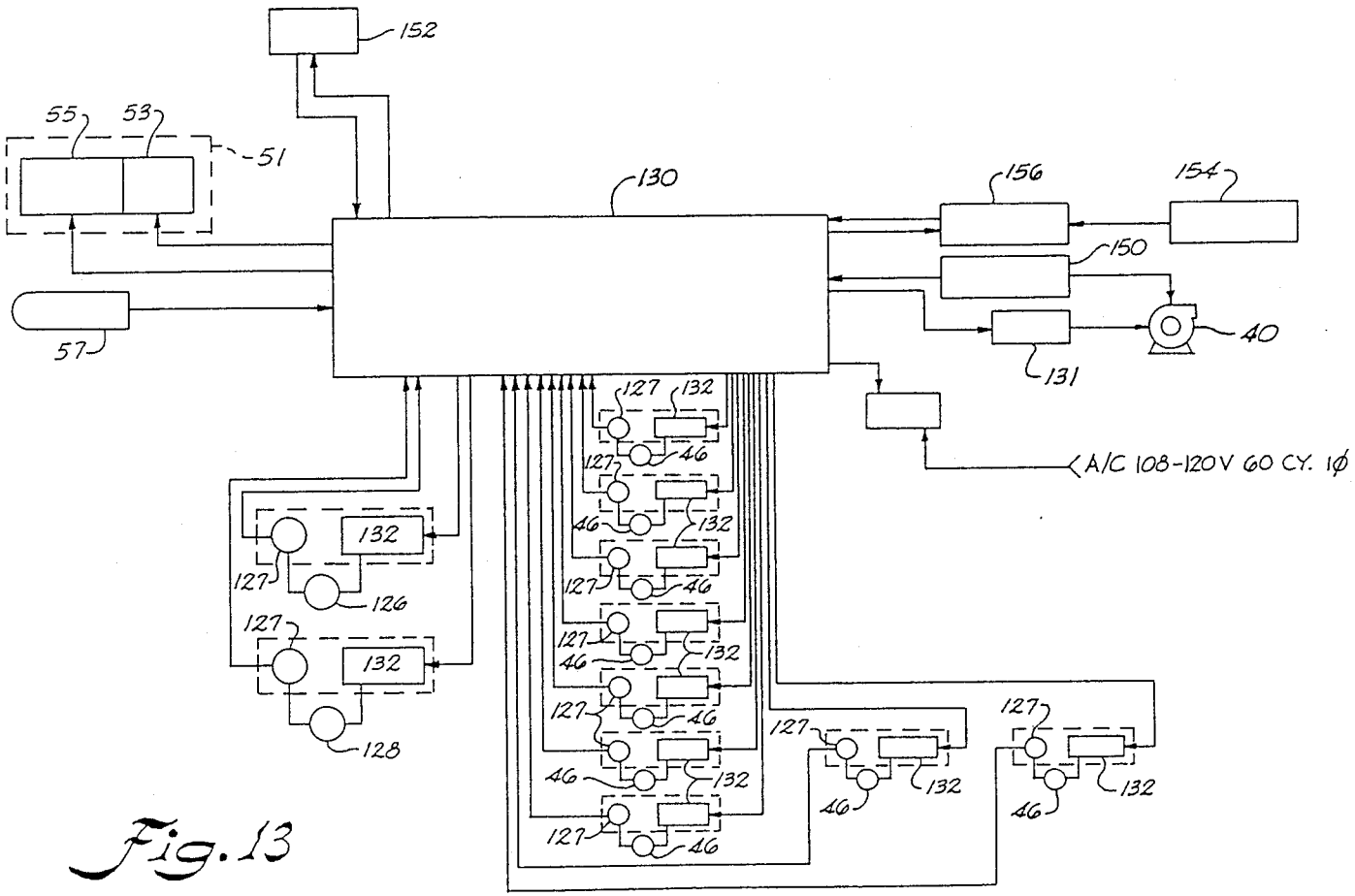
FIG. 13 illustrates a schematic diagram of components of an embodiment of the present invention.
Figure 15:
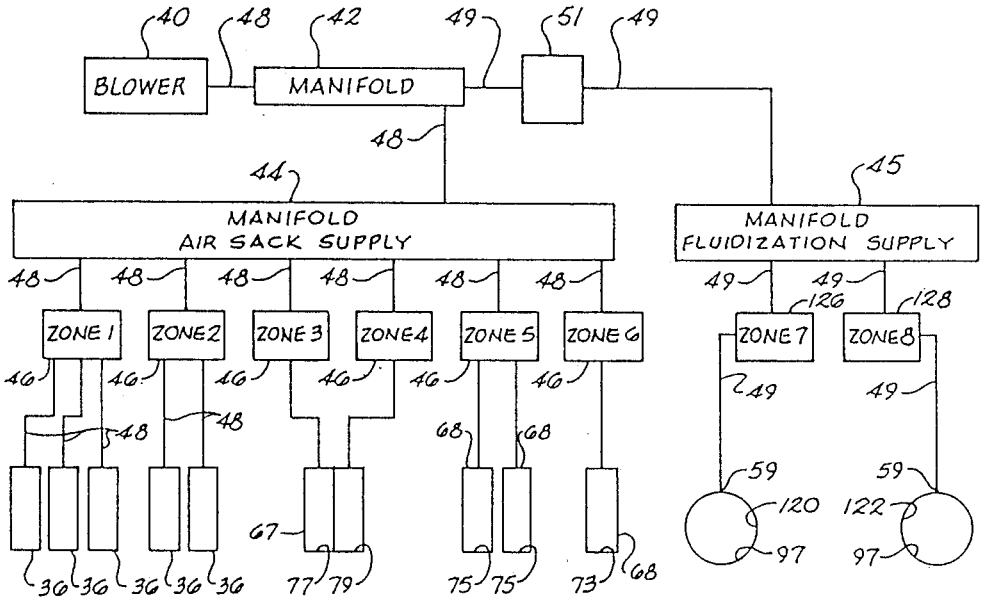
FIG. 15 illustrates a schematic diagram of components of an embodiment of the present invention.

In a preferred embodiment of the present invention illustrated in FIGS. 10, 13, and 15 for example, the plenum 97 formed between tank bottom 60 and diffuser board 52 is divided into at least two separate plenum chambers 120, 122. This arrangement enables air to be supplied to one chamber at a different pressure than air is supplied to the other chamber or chambers. As shown in FIG. 10 for example, plenum chamber 120 is separated from plenum chamber 122 by an air impermeable divider 124. Preferably, at least one plenum chamber 120 is disposed to support the buttocks of the patient, and the second plenum chamber 122 is disposed to support the legs and feet of the patient. Preferably, the superficial flow rate and the pressure of the air supplied by blower 40 to the buttocks plenum chamber 120 can be regulated so as to be higher than that supplied to plenum chamber 122 for the legs and feet.

As embodied herein and shown in FIG. 10 for example, diffuser board 52 defines a first tier 41 and a second tier 43. First tier 42 defines the section of diffuser board 52 forming buttocks plenum chamber 120 and is disposed closer to tank bottom 60 than second tier 43, which defines the section of diffuser board 52 forming plenum chamber 122, and which is disposed to fluidize the material 50 supporting the legs and feet of the patient. Thus, a deeper mass of fluidizable material 50 is supported by first tier 41 of diffuser board 52 over buttocks plenum chamber 120 than is supported by second tier 43 of diffuser board 52 over leg and foot plenum chamber 122. In other words, the height of fluidizable material 50 is larger above first tier 41 of diffuser board 52 at buttocks plenum chamber 120 than above second tier 43 of diffuser board 52 at leg and foot plenum chamber 122.

A three inch differential in the height of the fluidizable material constitutes a very significant reduction in the weight of the patient support system. Typical overall dimensions for the patient support system are thirtysix inches in width and ninety inches in length. The typical width of the mass of fluidizable material is twenty-four to twenty-six inches, and the length of same is on the order of fifty-one inches. At a uniform depth of nine inches, these dimensions define a substantial volume of fluidizable material. In the embodiment of the present invention shown in FIG. 10 for example, the mass of fluidizable material supporting the patient's buttocks typically measures eighteen inches long in the direction parallel to the length of the patient support system, and the leg and foot zone is typically thirty-three inches long. The height of fluidizable material above buttocks plenum chamber 120 is nine inches, and the height above the leg and foot chamber 122 is six inches. Accordingly, two-tiered plenum embodiments such as shown in FIG. 10 result in the reduction of a volume of fluidizable material measuring eighteen inches by twenty-six inches by three inches. If the fluidizable material is formed of glass microspheres, this reduces the weight of the patient support system by about 150 pounds. Moreover, this reduction in the volume of fluidizable material permits use of a smaller blower, which weighs less and thus further reduces the overall weight of the system. Furthermore, a smaller blower lowers the power requirements for operating the system.

Means are provided for supplying air to fluidize the fluidizable medium. The fluidizing means can include the plenum and the air supplying means communicates therewith. As embodied herein and shown schematically in FIG. 15 for example, the means for supplying air to fluidize the fluidizable medium preferably includes a blower 40, a blower manifold 42, a fluidization supply manifold 45, one or more flow control valves 126, 128, and a plurality of flexible air conduits 48, 49. Air travels from blower 40 to plenum 97 via blower manifold 42, tubes 48, a heat exchange device 51, tubes 49, a fluidization supply manifold 45, control valves 126 or 128, and opening 59 through tank bottom 60. In an alternative preferred embodiment (not shown) manifolds 42 and 45 can be combined in a single structure. Blower 40 preferably is capable of supplying forty cubic feet of standard air per minute to the plenum at a pressure of up to twenty-three inches of water, while simultaneously supplying air to air sacks 36 and any other components of the system which are inflatable or require air flow.

The fluidization of the mass of fluidizable material 50 preferably is carried out at different modes of fluidization. In the continuous mode of operation, air is continuously supplied to flow through at least one plenum chamber. There are essentially four continuous modes of operation for fluidization. The zero mode of fluidization embodies the condition when the amount of air passing through the mass of fluidizable material is insufficient to fluidize same. This occurs when the superficial velocity of air through the flow area presented by the fluidizable material is on the order of 0.01 feet per second. At the minimum mode of fluidization, sufficient air is passing through the fluidizable material 50 to render same fluidized and thus reduce the shear forces to essentially zero. At the minimum mode of fluidization the superficial velocity of the air passing through the fluidizable material is on the order of 0.04 feet per second. The maximum mode of fluidization is that which renders the fluidization turbulent and occurs at about a superficial flow velocity of 0.07 feet per second. Accordingly, the intermediate mode of fluidization occurs between the minimum mode of fluidization and the maximum mode of fluidization and generally begins at a superficial velocity of about 0.05 feet per second. In the intermittent mode of operation, the air flow is turned off for an interval of time and then turned on for an interval of time. The repetition of this sequence constitutes the intermittent fluidization mode of operation.

Means are provided for independently supplying air to each plenum chamber at independently preselected air flow rates. As embodied herein and shown schematically in FIGS. 13 and 15 for example, the means for separately supplying air to each plenum chamber at independently preselected air flow rates includes a flow control valve 126 for regulating the supply of air to plenum chamber 120 and a flow control valve 128 for regulating the supply of air to plenum chamber 122. The means for independently supplying air to each separate plenum chamber at a separate flow rate further includes a microprocessor 130 programmed to regulate flow control valve 126 and flow control valve 128. The means for supplying air to each separate plenum chamber at a separate flow rate further includes a flow sensing device such as an air velocity sensing device 127 disposed to measure the flow through each flow control valve 126, 128.

Means also are provided for intermittently supplying air flow to at least one of plenum chambers 120, 122. In this way, the mass of fluidizable material disposed above at least one of plenum chambers 120, 122 and preferably one or both plenum chambers 120, 122 can be fluidized intermittently. As embodied herein and shown in FIGS. 13 and 15 for example, the means for intermittently supplying air flow to at least one plenum chamber preferably includes a microprocessor 130 controlling actuation of the flow control valve 126 or 128 which regulates air flow to the plenum chamber which is selected for an intermittent mode of air flow supply. Each plenum chamber 120, 122 is supplied with air through respective flow control valve 126, 128. The amount of air flow permitted to pass through each flow control valve 126, 128 is controlled by microprocessor 130 according to a preprogrammed set of instructions stored in the memory of microprocessor 130.

For example, during a given interval of time between one and five minutes, the appropriate flow control valve 126 or 128 is closed to prevent any air flow from reaching the respective plenum chamber 120 or 122. In other words, the fluidizable material supported above such plenum chamber is maintained in an unfluidized state. After the passage of this predetermined interval, which can be preset via a control panel which inputs the desired interval into the appropriate set of instructions stored in microprocessor 130, microprocessor 130 opens the appropriate flow control valve to permit at least a minimum level of fluidization of material 50 supported above the corresponding plenum chamber and maintains this minimum fluidization for about one-half to ten seconds for example. One or both or neither plenum chamber can be operated according to the intermittent mode of fluidization, as desired by selecting this mode on the control panel which sends the appropriate signal to microprocessor 130.

Figure 11:
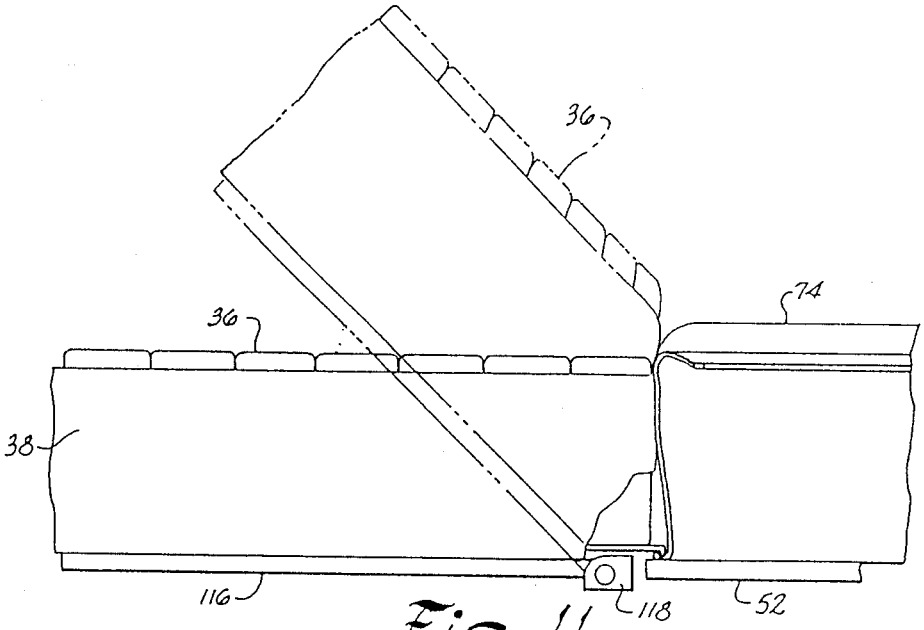
FIG. 11 illustrates a side, partially cut-away, plan view of components of an embodiment of the present invention.

As shown in FIGS. 10 and 11 for example, frame 32 includes an articulatable member 116, which pivots about an articulation joint 118. Preferably, member 116 has a range of inclination from 0° to 60° from the horizontal. Microprocessor 130 also controls articulation of articulatable member 116 via conventional hydraulics and motors indicated schematically in FIG. 13 by the articulation package designated 152. Sensing devices also are included in this articulation package 152, as indicated schematically in FIG. 13 by the return arrow toward microprocessor 130. These sensing devices provide microprocessor 130 with information regarding the degree of articulation of articulatable member 116.

As embodied herein and shown for example in FIG. 1, frame 32 carries a plurality of inflatable sacks 36 disposed transversely across articulatable member 116 to support at least a portion of the patient's body. The head and upper torso of a patient preferably rests atop inflatable sacks 36, which preferably are covered by a conventional hospital sheet and/or other bedding (not shown). A continuous retaining panel 38 preferably is attached to sacks 36 and surrounds same to retain same together in an orderly fashion. Any conventional means of attachment such as snaps or zippers can be used to connect retaining panel 38 to sacks 36. As shown in FIG. 10 for example, each sack 36 preferably is ten and one-half inches in height measured above articulatable member 116 and about thirty-three and one-half inches long measured in a direction transversely across member 116. The thickness of each sack 36 is approximately four and one-half inches. As illustrated in FIG. 11 for example, elevation of member 116 from the horizontal position deforms the two sacks closest to the articulation joint 118 to accommodate the change in position of member 116.

Means are provided for maintaining a preselected pressure in each inflatable sack. As embodied herein and shown schematically in FIG. 15 for example, the means for maintaining a preselected pressure in each inflatable sack includes a blower 40, a blower manifold 42, an air sack manifold 44, a plurality of pressure control valves 46, and a plurality of air impermeable tubes 48. Tubes 48 connect blower manifold 42 to blower 40 and to air sack manifold 44, and connect pressure valves 46 to air sack supply manifold 44 and to sacks 36. As shown in FIG. 13 for example, each pressure control valve 46 preferably includes a pressure transducer 127 which monitors the pressure at the outlet of valve 46. Each valve 46 further preferably includes an electric motor 132 to regulate the flow permitted to pass through valve 46 and accordingly the pressure being sensed by transducer 127.

As embodied herein and shown schematically in FIG. 13 for example, the means for maintaining a preselected pressure in each inflatable sack further includes a microprocessor 130. Microprocessor 130 controls blower 40 via a blower control board 131 and receives signals from a pressure sensor 150 which monitors the pressure at the outlet side of blower 40. This determines the basic overall pressure level being supplied by blower 40. Furthermore, each pressure transducer 127 sends a signal to microprocessor 130 indicative of the pressure at the outlet of each valve 46. Microprocessor 130 compares this signal to a signal stored in its memory corresponding to a preset pressure for that particular valve 46. Depending upon the results of the comparison, microprocessor 130 controls motor 132 to open or close valve 46 until the comparison indicates that the preset pressure has been attained. As shown in FIG. 13 for example, the preset pressure for each valve can be stored in the memory of microprocessor 130 via a key pad 154 and a control panel 156.

Figure 14:
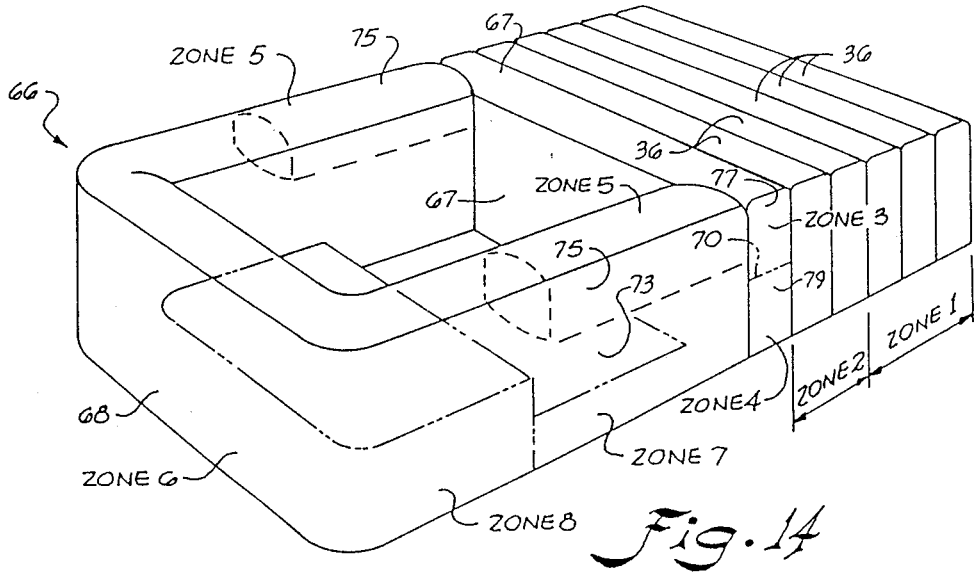
FIG. 14 illustrates a perspective view of components of an embodiment of the present invention.

Means are provided for retaining the fluidizable medium generally above the supporting and diffusing means and thus above the air plenum. The retaining means is carried by the frame. As embodied herein and shown for example in FIGS. 7, 8, 9, 10, 11, 12*a*, 12*b*, and 12*c* for example, the means for retaining the fluidizable medium generally above the supporting and diffusing means preferably includes an elastic wall, which can exist in a number of different embodiments. As shown in FIG. 1 for example, the elastic wall is indicated generally in the figures by the designating numeral 66. As shown in FIGS. 1, 2*a*, 2*b*, 10, and 14 for example, elastic wall 66 can comprise an inflatable U-shaped member 68. As shown in FIGS. 2*a*, 2*b*, and 10 for example, inflatable U-shaped member 68 preferably comprises a plurality of internal webs 70 which subdivide the interior space of member 68 into a plurality of compartments 72*a*, 72*b* and 72*c*. At least a single web 70 defines two compartments 72, and the lower compartments are the ones closer to diffuser board 52. In some embodiments, the upper compartments can be separately pressurizable from the lower ones. As shown in FIGS. 3*a*, 8, 9 and 14 for example, elastic wall 66 can include an inflatable interface sack 67 extending across the open end of tank 58 and providing the interface between the fluidizable material 50 and inflatable sacks 36. As shown in FIGS. 3*a*, 8, 9, and 14 for example, interface sack 67 preferably includes two compartments 77, 79 which are separated by web 70 and separately pressurizable. As shown in FIG. 14 for example, elastic wall 66 comprises interface sack 67 and U-shaped member 68. U-shaped member 68 comprises upper compartments 75 and lower compartment 73. Interface sack 67 is disposed across the open end of U-shaped member 68. By supplying air to each of compartments 73, 75, 77, and 79 via a separate pressure valve 46, the lower compartments 73, 79 can be maintained at a higher pressure than the upper compartments 75, 77. This facilitates enhancing the comfort of the patient coming into contact with upper compartments 75, 77, while providing more rigidity to lower compartments 73, 79, which bear more of the burden of retaining fluidizable material 50. The lower pressure renders upper compartments 75, 77 more deformable than the lower compartments and thereby facilitates patient ingress and egress to and from the fluidizable support. Interface sack 67 can be integrally formed with U-shaped member 68 by having common exterior wall panels. In other embodiments, the exterior wall panels of U-shaped member 68 and interface sack 67 can be joined in air-tight fashion. As shown in FIG. 14 for example, interface sack 67 is configured with the same exterior dimensions as inflatable sacks 36 and is largely indistinguishable from same when judged by outward appearances.

Figure 3B:
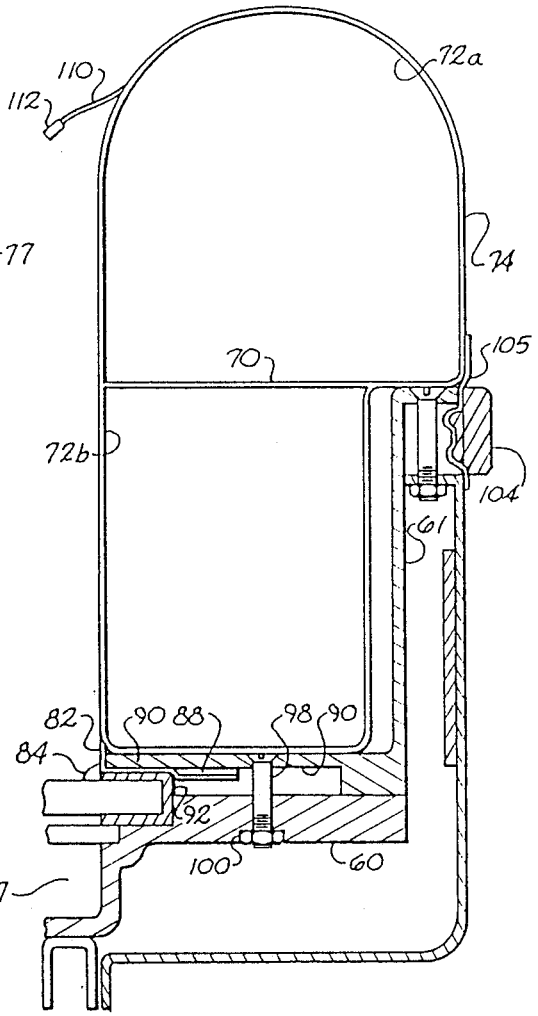
FIG. 3*b* illustrates a partial, detailed cross-sectional view of components of an embodiment of the present invention taken in a direction similar to the lines 2—2 of FIG. 1.

In the embodiments of elastic wall 66 illustrated in FIGS. 2*a*, 2*b*, 3*b*, 4, 6, and 10 for example, the uppermost compartment 72*a* is larger than the lower compartments 72*b*, 72*c* and forms an overhanging portion 74 which extends over the free edge of sidewalls 61, 62 and end wall 64 of tank 58. As shown in FIG. 3*b* for example, an elastomeric fastener 104 retains a securing flap 105 by press fitting flap 104 into a receptacle therefor, and so secures the elastic wall to the sidewall of the tank. In an embodiment such as shown in FIG. 7 for example, all compartments 72 are similarly configured. As shown in FIG. 2*c* for example, an embodiment of an uppermost compartment 76 has a hemispherical shape and does not have an overhanging portion.

Figure 3C:
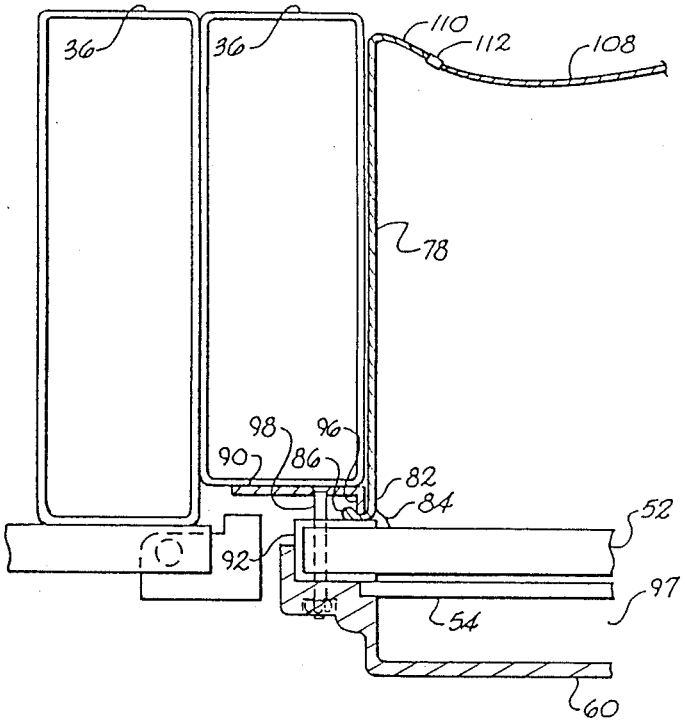
FIG. 3*c* illustrates a detailed cross-sectional view of components of an embodiment of the present invention taken along the lines 3—3 of FIG. 1.

As shown in FIGS. 3*c*, 10, 12*a*, 12*b*, and 12*c*, one alternative embodiment of elastic wall 66 comprises a non-rigid panel 78 which is impermeable to the passage of both air and fluidizable material. Panel 78 preferably is formed of a fabric coated with polyurethane or the like. As shown in FIG. 3*c* for example, panel 78 rests against an inflatable sack 36, which together with the other inflatable sacks 36 provide sufficient rigidity to retain the fluidizable material generally above diffuser board 52.

As shown in FIG. 6 for example, an embodiment of elastic wall 66 can include a plurality of deformable inserts 80 disposed within and substantially filling each compartment formed by an embodiment of impermeable panel 78 which has been configured to completely envelope inserts 80. Each insert 80 preferably is formed of polyurethane foam or a polymeric deformable material. Moreover, some compartments can include an insert 80, while other compartments need not include an insert 80.

Figure 12A:
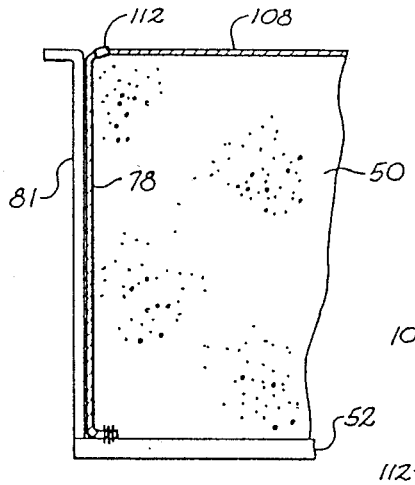
FIG. 12*a* illustrates a partial cross-sectional view of components of an embodiment of the present invention in a fluidized state.
Figure 12B:
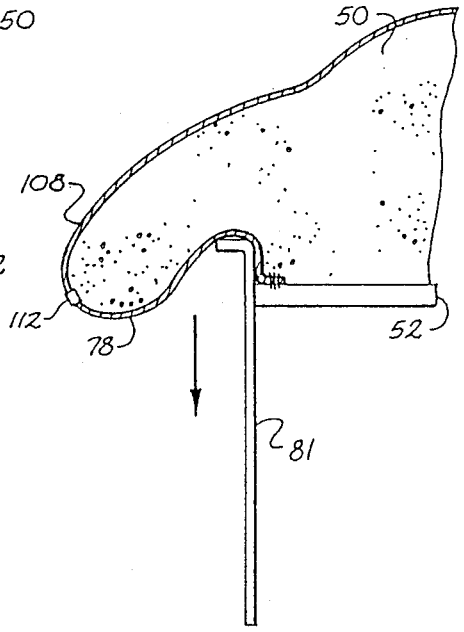
FIG. 12*b* illustrates a partial cross-sectional view of components of an embodiment of the present invention in a defluidized state.
Figure 12C:
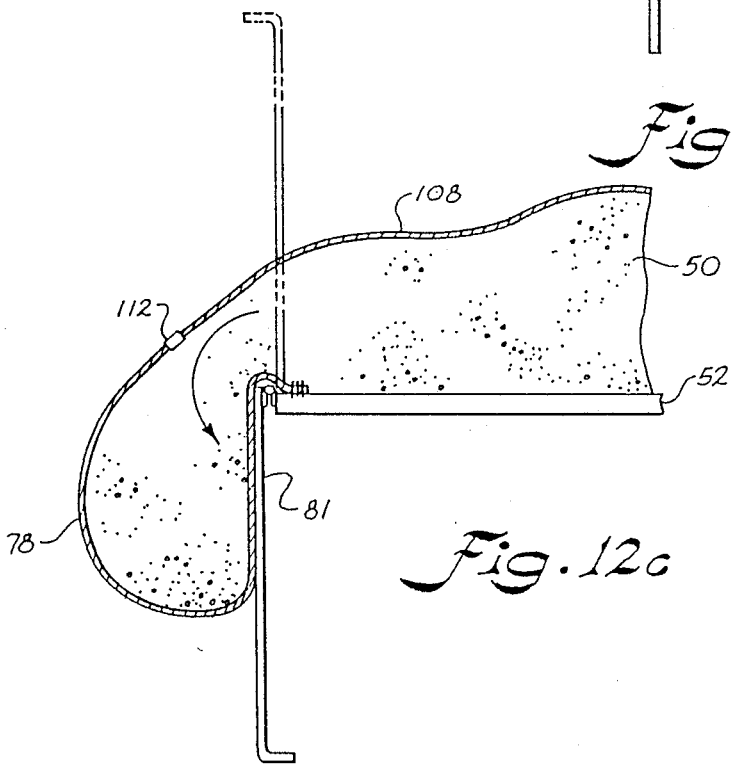
FIG. 12*c* illustrates a partial cross-sectional view of components of an embodiment of the present invention in a defluidized state.

As shown in FIGS. 12*a*–12*c* for example, the means for retaining the fluidizable material over a predetermined air permeable section of the plenum defining means can include a rigid tank sidewall 81, an elastic wall embodiment such as a flexible impermeable panel 78, and an air permeable sheet 108 connected to air impermeable panel 78. Though not shown in FIG. 12, panel 78 can be disposed without interruption around the sides and closed end of tank 58, and an interface sack 67 can be used to retain the fluidizable material at the open end of tank 58. In other embodiments, panel 78 completely surrounds the fluidizable material.

In order to facilitate patient ingress to and egress from the patient support system, at least a section of rigid sidewall 81 is selectively collapsible, either via a grooved track mechanism as illustrated schematically in FIG. 12*b* or by a bottom hinged mechanism illustrated schematically in FIG. 12*c*. Air permeable sheet 108 is impermeable to passage of fluidizable material therethrough and is joined at its periphery to panel 78 by an air tight means of attachment such as an air tight zipper 112 or an elastomeric attachment 114 (FIG. 5).

Figure 4:
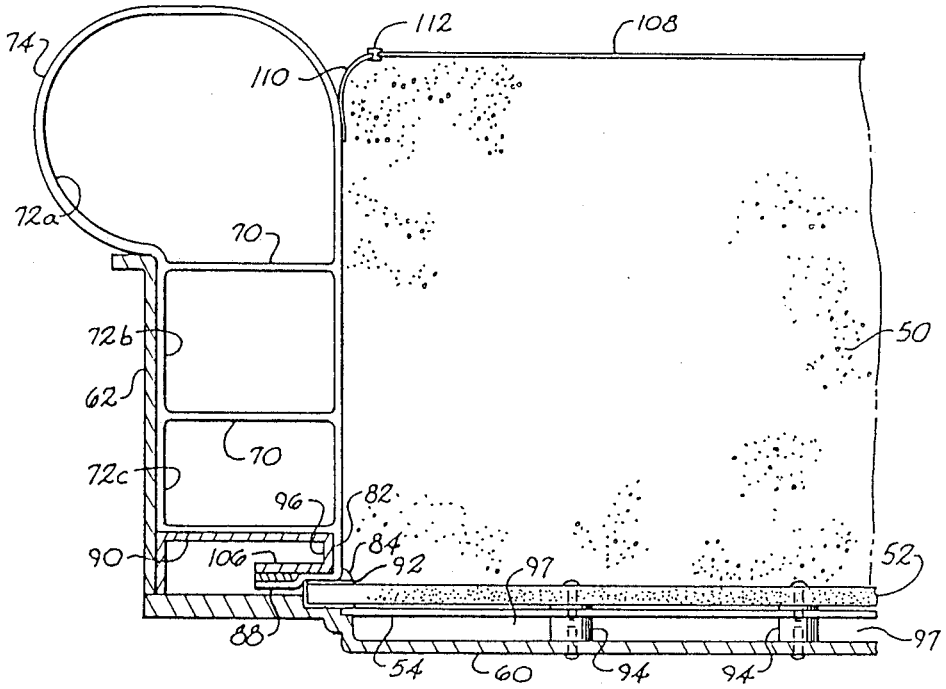
FIG. 4 illustrates a partial, detailed cross-sectional view of components of an embodiment of the present invention in a fluidized state taken along the lines 4—4 of FIG. 1.

The manner by which the retaining means confines the fluidizable medium generally above the supporting and diffusing means is most easily explained by reference to FIGS. 3 and 4 for example. The elastic wall has an attachment flap 82. The free end of attachment flap 82 has an anchoring member, which can for example be a cord 86 in some embodiments (FIGS. 3*c*, and 7) or a velcro strip 88 in others (FIGS. 3*a*, 3*b*, 4, and 6). As shown in FIGS. 3*a*, 3*b*, 4, and 6 for example, a rigid clamping channel 90 rests atop tank bottom 60. The free edge of diffuser board 52 is surrounded by a silicone rubber sleeve 92 to form an air-impermeable fitting around the entire free edge of diffuser board 52. In a preferred embodiment, a plurality of support posts 94 (FIG. 4) separates diffuser board 52 and perforated metal plate 54 from tank bottom 60 and support diffuser board 52 and plate 54 above tank bottom 60. Attachment flap 82 extends between the outer surface of an inner leg 96 of clamping channel 90 and sleeve 92. Then attachment flap 82 extends around inner leg 96 so that the anchoring member (86 or 88) extends beyond the inner surface of inner leg 96 as shown in FIGS. 3*c* and 4 for example. Clamping channel 90 is secured to tank bottom 60 via a clamping bolt 98 and a nut 100. Thus, attachment flap 82 is secured in air tight fashion between tank bottom 60 and the free end of inner leg 96 of clamping channel 90. A bead 84 of an air impermeable sealant is applied between sleeve 92 of diffuser board 52 and elastic wall 66. Bead 84 preferably is formed of any room temperature vulcanizing compound (RTV), such as a silicone rubber composition which hardens after exposure to air at room temperature. In this way, air entering a plenum 97 formed between diffuser board 52 and tank bottom 60 cannot escape past the free edge of diffuser board 52 or inner leg 96 of clamping channel 90. Furthermore, elastic wall 66 is air impermeable. Thus, air entering plenum 97 under pressure from blower 40 must pass up through diffuser board 52 into the fluidizable material supported thereabove.

FIG. 3*a* illustrates one embodiment of interface sack 67 of elastic wall 66 which extends across the open end of tank 58. Tank bottom 60 supports the free edges of perforated plate 54 and diffuser board 52, and silicone rubber sleeve 92 surrounds the free edge of diffuser board 52 to prevent air from escaping through the free edge of diffuser board 52. A clamping channel 90 secures and seals attachment flap 82 against sleeve 92 in an air-tight fashion and has an anchoring flange 106. In this embodiment, the anchoring member comprises a hook and loop strip 88 which attaches to a mating hook and loop strip, such as a VELCRO strip, secured to the underside of anchoring flange 106 of clamping channel 90. Clamping bolts 98 are used to secure clamping channel 90 against tank bottom 60 and diffuser board 52. Moreover, clamping channel 90 can be provided with openings (not shown) through which tubes (not shown) or other conduits for supplying gas to elastic wall 66 can be passed.

FIGS. 3*c* and 10 illustrate another preferred embodiment of elastic wall 66 which extends across the open end of tank 58. Tank bottom 60 supports the free edges of perforated plate 54 and diffuser board 52, and silicone rubber sleeve 92 surrounds the free edge of diffuser board 52 to prevent air from escaping through the free edge thereof. A clamping member 90 secures and seals attachment flap 82 of panel 78 against sleeve 92 in an air-tight fashion and has an inner leg 96. As shown in FIG. 3*c* in this embodiment, the anchoring member comprises a cord 86 which rests against the inner surface of inner leg 96. Clamping channel 90 is secured to tank bottom 60 via a clamping bolt 98 and nut 100. Thus, attachment flap 82 is secured in air-tight fashion between inner leg 96 of clamping channel 90 and silicon sleeve 92. A bead 84 of RTV is applied between sleeve 92 and flexible panel 78. In this way, air entering a plenum 97 formed between diffuser board 52 and tank bottom 60 cannot escape pass the free edge of diffuser board 52 or inner leg 96 of clamping channel 90. Furthermore, air impermeable panel 78 forces air entering plenum 97 and passing through diffuser board 52 to pass through the fluidizable material before exiting through an air permeable sheet 108 connected to panel 78 via an air-tight zipper 112 for example.

Means are provided for supplying air at a plurality of independently determinable pressures to separate pressure zones of the patient support system and at a plurality of independently determinable air flow rates to separate flow rate zones of the patient support system. In a preferred embodiment illustrated in FIGS. 14 and 15 for example, the various facilities of the patient support system requiring a supply of air are assigned a separate valve to facilitate effecting independent levels of pressurization and/or rates of air flow. These various facilities include air sacks 36, air plenum 97, air plenum chambers 120, 122, and interface sack 67 and the other inflatable components of elastic wall 66. Each valve segregates a separate zone, and thus air from blower 40 is provided to a plurality of separately controllable zones. Each separate zone is controlled by either a pressure control valve 46 or a flow control valve 126, 128. Each pressure control valve and flow control valve is controlled by microprocessor 130 such as shown in FIG. 13 for example. Each pressure control valve 46 and flow control valve 126, 128 has a pressure sensing device which measures the pressure at the outlet of the valve and sends a signal indicative of this pressure to microprocessor 130. As embodied herein, a transducer 127 provides a suitable pressure sensing device. Each valve 46, 126, 128 further comprises an electrically operated motor 132 which opens and closes each valve. Microprocessor 130 controls each motor 132 of each valve, and a preselected pressure or flow for each valve can be selected and stored in the memory of microprocessor 130 via key pad 154 and control panel 156. Microprocessor 130 is programmed to control motor 132 so as to regulate the pressure or flow through the valve in accordance with the preselected value of pressure or flow stored in the memory of microprocessor 130. Similarly, microprocessor 130 can be programmed to change the preselected pressure or flow through one or more of valves 46, 126, 128.

As shown in FIG. 15, for example, individual sacks or groups of sacks can be associated with a single zone which is supplied by a single pressure control valve 46. Accordingly, all of the sacks controlled by a single pressure control valve 46 can be maintained at the same pressure by the microprocessor, which uses the valve's transducer 127 to monitor the pressure at the valve's outlet.

In one embodiment illustrated in FIGS. 14 and 15 for example, eight different zones are each independently maintainable at a different pressure and/or flow rate of air by blower 40. Zone 1 includes a plurality of inflatable sacks 36, which preferably lack any air escape holes. Occasionally, a small amount of air will leak from the seams of sacks 36. However, such leakage, if any, is essentially inconsequential. Blower 40 provides sufficient air to sacks 36 in zone 1 to maintain them at a pressure between one and twenty inches of water. Zone 2 includes a plurality of air sacks 36, which preferably lack air escape holes. Blower 40 supplies air to sacks 36 in zone 2 at a pressure that can be varied between zero and twenty inches of water. Zone 3 includes upper compartment 77 of interface sack 67, and blower 40 supplies air thereto at a pressure that can be varied between zero and twenty inches of water. Since no air escape holes are provided in interface sack 67, the flow rate of air provided to compartment 77 is essentially zero as it is due primarily to leakage at seams. Zone 4 includes lower compartment 79 of interface sack 67, and blower 40 supplies air thereto at a pressure that can be varied between zero and twenty inches of water, and the flow rate of air is once again essentially zero. Zone 5 includes upper compartments 75 of U-shaped member 68 of elastic wall 66. Compartments 75 lack any air escape holes, and blower 40 supplies air to compartments 75 at a pressure that can be varied between zero and twenty inches of water and a flow rate of essentially zero cubic feet per minute. Zone 6 includes lower compartment 73 of U-shaped member 68, and compartment 73 similarly lacks any air escape holes. Blower 40 supplies air to compartment 73 in pressure zone 6 at a pressure that can be varied between zero and twenty inches of water, and the air flow rate is essentially nil for reasons explained above. Zone 7 is a flow rate zone and includes buttocks plenum chamber 120 of plenum 97 illustrated in FIG. 10 for example. Similarly, zone 8 includes plenum chamber 122, which is disclosed to provide air to fluidize the mass of fluidizable material 50 disposed to support the legs and feet of the patient. During fluidization of the mass of fluidizable material, blower 40 supplies air in zone 7 to buttocks plenum chamber 120 at a pressure between twelve and twenty-two inches of water and a flow rate between five and twenty cubic feet per minute. Similarly, blower 40 supplies air in zone 8 to legs and feet plenum chamber 122 during fluidization of the mass of fluidizable material thereabove at a pressure of between six and eighteen inches of water and a flow rate of between five and twenty-eight cubic feet per minute.

If it is desired to permit egress from or ingress to the patient support system embodiment shown in FIG. 14 for example, the pressure control valve supplying air to compartments 75 can be controlled by microprocessor 130 through suitable controls on key pad 154 so as to reduce the pressure within compartments 75. The reduced pressure renders them soft enough to permit the patient to slide over them relatively easily. At the same time, the pressure control valve regulating the pressure in compartment 73 of elastic wall 66 can be maintained high enough to provide sufficient rigidity to the remainder of the elastic wall so as to prevent the fluidizable material from unduly deforming elastic wall 66 while the patient is entering or exiting the fluidizable support. Similarly, upper compartment 77 and lower compartment 79 of interface sack 67 can be maintained at different pressures if each is supplied by a different pressure control valve 46. In this way, the lowermost compartment 79 can be maintained at a higher pressure than upper compartment 77 to facilitate retaining the mass of fluidizable material. Maintaining a lower pressure in upper compartment 77 permits it to be compressed for the comfort of the patient, or when the articulatable member is raised to form an angle of inclination with the horizontal as shown in FIG. 11 for example. The pressure in compartment 77 can be lowered automatically by suitable programming of the microprocessor to control the pressure in compartment 77 during articulation of member 116.

Each control valve 46 can be operated in a so-called dump mode which permits instantaneous opening of the valve so as to permit instantaneous depressurization through the valve. Thus, pressure control valves 46 are capable of operating as would a solenoid valve insofar as depressurization is concerned. This mode of valve operation permits instantaneous deflation of inflatable sacks 36 for example. Such deflation is desirable to permit a cardiopulmonary resuscitation (CPR) procedure to be performed on a patient. Such procedure requires a rigid surface rather than the compressible surface provided by inflatable sacks 36. Key pad 154 of control panel 156 signals microprocessor to trigger the pressure control valves 46 to the dump mode.

As shown schematically in FIG. 15 for example, a heat exchange device 51 also can be provided to regulate the temperature of the air supplied to fluidize the mass of material 50. As shown schematically in FIG. 13 for example, microprocessor 130 also controls heat exchange device 51, which includes a heater 53 and a heat exchanger 55. A temperature probe 57 can be provided and disposed so as to record the temperature inside fluidizable material 50 and provide a signal to microprocessor 130. Microprocessor 130 then activates heater 53 to regulate the temperature of the mass of fluidizable material according to predetermined temperature range parameters stored in the memory of microprocessor 130. Microprocessor 130 also can display the temperature on control panel 156 for example.

Means are provided for defluidizing the mass of fluidizable material during elevation of the articulatable member. As embodied herein and shown schematically in FIG. 13 for example, the means for defluidizing the mass of fluidizable material during elevation of the articulatable member preferably includes articulation package 152 and microprocessor 130. As embodied herein, the conventional hydraulics and motors in articulation package 152 raise articulatable member 116, and the sensing devices monitor the degree of articulation of member 116. Instructions concerning the degree of elevation of articulation member 116 are inputted to microprocessor 130 by the operator via key pad 154 and control panel 156. Microprocessor 130 then activates the conventional hydraulics and motors until the articulation sensing device signals that the inputted level of articulation has been attained. In conjunction with the actuation of the conventional hydraulics and motors to begin elevating articulatable member 116, microprocessor 130 causes flow control valve 126 governing fluidization of buttocks plenum chamber 120 (shown in FIG. 10 for example) to close. This defluidizes the mass of fluidizable material supporting the buttocks of the patient. The defluidization of material 50 supporting the buttocks of the patient acts to prevent the buttocks from moving in a direction toward the feet of the patient as weight is transferred against the buttocks during elevation of the head and chest of the patient. Thus, the defluidization of the mass of fluidizable material supporting the buttocks acts as a substitute for a knee patch that often is required when elevating the head and chest of a patient on the articulatable member of a conventional low air loss bed. The prevention of movement of the buttocks has the added beneficial result of restraining the patient from any slipping and sliding that might cause tissue damage to any sacral skin grafts which may exist on the patient.

After the articulatable member has attained the desired angle of elevation, the microprocessor preferably is programmed to signal flow control valve 126 to open for a very brief period of time. The duration of this brief period is no longer than required to contour the mass of fluidizable material for supporting the buttocks in the sitting position which has been attained by the patient. For example, the duration of this brief period is not long enough to result in the patient feeling the sensation of sinking into the mass of fluidizable material in the buttocks zone.

What is claimed is:

1. A patient support system, comprising:

(a) a frame;

(b) a mass of fluidizable material carried by said frame;

(c) means for containing said mass of fluidizable material in at least two selectively separable enclosed masses of fluidizable material; and (d) means to fluidize said fluidizable material.

2. An apparatus as in claim 1, wherein:

said containing means includes at least two fluidizable cells.

3. An apparatus as in claim 2, wherein:

each said cell having an upper wall, a lower wall, and a sidewall extending between and connecting said upper wall and said lower wall, each said cell containing a mass of fluidizable material, each said upper wall and said lower wall being permeable to air and impermeable to said fluidizable material, each said cell sidewall being impermeable to said fluidizable material.

4. An apparatus as in claim 1, wherein:

said containing means includes at least two fluidizable cells, each said fluidizable cell having a lower wall that is permeable to air, each said cell being disposed adjacent at least one other fluidizable cell; and the apparatus further comprising means for connecting each said fluidizable cell to the support system so as to ensure adequate flow of air through said lower walls to fluidize the mass of fluidizable material contained in said cells.

5. An apparatus as in claim 4, wherein:

said connecting means includes an airtight zipper.

6. An apparatus as in claim 4, wherein:

said connecting means includes mating elastomeric members.

7. An apparatus as in claim 4, wherein:

said connecting means being selectively engagable and disengagable to permit removal of each fluidizable cell and replacement of said removed fluidizable cell with a replacement fluidizable cell.

8. An apparatus as in claim 1, further comprising:

an air permeable support carried by said frame; and wherein said containing means includes at least two fluidizable cells, each said cell having an air permeable lower wall disposed above said air permeable support.

9. An apparatus as in claim 8, wherein:

each said cell being disposed adjacent at least one other fluidizable cell; and the apparatus further comprising means for connecting at least a portion of each said fluidizable cell to said air permeable support so as to ensure adequate flow of air through said lower walls to fluidize the mass of fluidizable material contained in said cells.

10. An apparatus as in claim 9, wherein:

said connecting means being selectively engagable and disengagable to permit removal of each fluidizable cell and replacement of said removed fluidizable cell with a replacement fluidizable cell.

11. An apparatus as in claim 9, wherein:

said connecting means includes an airtight zipper.

12. An apparatus as in claim 9, wherein:

said connecting means includes mating elastomeric members.

13. An apparatus as in claim 8, further comprising:

a plenum carried by said frame and having said air permeable support forming an upper surface of said plenum;

said plenum being divided into at least two separately pressurizable chambers;

said support defining a first tier disposed above one of said separately pressurizable plenum chambers and a second tier disposed above a second of said separately pressurizable plenum chambers; and wherein the depth of fluidizable material supported by said first tier is greater than the depth of fluidizable material supported by said second tier.

14. An apparatus as in claim 13, wherein:

said first tier is disposed to support the patient's buttocks and said second tier is disposed to support the patient's legs and feet.

15. An apparatus as in claim 1, wherein:

said containing means includes at least two fluidizable cells, each said cell having an upper wall permeable to air; and the apparatus further comprising an elastic wall connected to at least two said fluidizable cells so as to form a substantially air impermeable seal between said elastic wall and at least a portion of the periphery of each of at least two said fluidizable cells in the vicinity of said upper wall.

16. An apparatus as in claim 1, wherein:

said containing means includes at least two fluidizable cells, each said cell having a lower wall permeable to air; and the apparatus further comprising an elastic wall connected to at least two said fluidizable cells so as to form a substantially air impermeable seal between said elastic wall and at least a portion of the periphery of each of at least two said fluidizable cells in the vicinity of said lower wall.

17. An apparatus as in claim 1, further comprising:

an air permeable support carried by said frame;

wherein said containing means includes at least two fluidizable cells, each said cell having a lower wall permeable to air; and said support being connected to at least two said fluidizable cells so as to form a substantially air impermeable seal between said support and at least a portion of the periphery of each of at least two said fluidizable cells.

18. A patient support system, comprising:

(a) a frame;

(b) a mass of fluidizable material carried by said frame;

(c) means for enclosing and containing said mass of fluidizable material and permitting selective manual removal of the enclosing and containing means from the support system with prior removal of said mass of fluidizable material from said enclosing and containing means, said enclosing and containing means including vertically spaced apart opposing walls, each said wall being permeable to air; and (d) means to fluidize and said fluidizable material.

19. An apparatus as in claim 18, wherein:

said enclosing and containing means includes at least one fluidizable cell.

20. An apparatus as in claim 18, wherein:

each said cell having an upper wall, a lower wall, and a sidewall extending between and connecting said upper wall and said lower wall, each said cell containing a mass of fluidizable material, each said upper wall and said lower wall being permeable to air cell sidewall being impermeable to said fluidizable material.

21. An apparatus as in claim 20, wherein:

each said cell sidewall being impermeable to air passing from within said cell to outside of said cell.

22. An apparatus as in claim 18, wherein:

said enclosing and containing means being selectively engagable to and disengagable from the support system, without the aid of tools, to permit removal of said enclosing and containing means from the support system and replacement of said removed enclosing and containing means with a replacement enclosing and containing means.

23. An apparatus as in claim 18, further including:

means for manually, selectively, and detachably connecting said enclosing and containing means to the support system.

24. An apparatus as in claim 23, wherein:

said connecting means includes at least one pair of mating elastomeric members.

25. An apparatus as in claim 23, wherein:

said connecting means includes at least one airtight zipper.

26. A patient support system, comprising:

(a) a frame;

(b) a mass of fluidizable material carried by said frame;

(c) at least two cells, each said cell containing a selectively separable portion of said mass of fluidizable material, each said cell having an upper wall, a lower wall, and a sidewall extending between and connecting said upper wall and said lower wall, each said upper wall and said lower wall being permeable to air and impermeable to said fluidizable material, each said cell sidewall being impermeable to said fluidizable material and substantially impermeable to air passing from within said cell to outside of said cell, each said cell being disposed adjacent at least one other cell;

(d) an air permeable support carried by said frame;

(e) means for connecting said fluidizable cell to said support so as to ensure adequate flow of air through said lower walls to fluidize said mass of fluidizable material contained in said cells; and (f) said connecting means being selectively engagable and disengagable to permit manual removal of each fluidizable cell and replacement of said removed fluidizable cell with a replacement fluidizable cell without the aid of tools.

* * * * *

UNITED STATES PATENT AND TRADEMARK OFFICE

CERTIFICATE OF CORRECTION

PATENT NO. : 4,967,431

DATED : November 6, 1990

INVENTOR(S) : Hargest et al

It is certified that error appears in the above-identified patent and that said Letters Patent is hereby corrected as shown below:

Column 23, line 41: change "with" to read --without--.

Column 24, line 3: type the phrase --and impermeable to said fluidizable material, each said-- after the word "air."

Signed and Sealed this

Twenty-first Day of April, 1992

*Attest:*

HARRY F. MANBECK, JR.

*Attesting Officer*

*Commissioner of Patents and Trademarks*